United States Patent [19]

Stertzbach

[11] 4,212,136

[45] Jul. 15, 1980

[54] ABRADING ELEMENTS

[75] Inventor: Glenn A. Stertzbach, Getzville, N.Y.

[73] Assignee: Vonscot Industries, Clarence, N.Y.

[21] Appl. No.: 860,910

[22] Filed: Dec. 15, 1977

[51] Int. Cl.[2] ..... B24D 5/00; B24D 17/00

[52] U.S. Cl. ..... 51/204; 51/331; 51/338

[58] Field of Search ..... 51/204, 206.4, 206.5, 51/331, 338, 346

[56] References Cited

U.S. PATENT DOCUMENTS

| | | | |
|---|---|---|---|
| 1,604,943 | 10/1926 | Larsson | 51/206.4 |
| 1,908,218 | 5/1933 | Calvert | 51/331 |
| 2,000,611 | 5/1935 | Prange | 51/204 |
| 2,083,400 | 6/1937 | Rose et al. | 51/346 |
| 2,265,377 | 12/1941 | Kline | 51/346 |
| 2,445,277 | 7/1948 | Mitchell | 51/346 |
| 2,467,094 | 4/1949 | Peden | 51/204 |
| 2,675,654 | 4/1954 | Harris, Jr. | 51/204 |
| 2,991,597 | 7/1961 | Calvert | 51/204 |
| 3,016,660 | 1/1962 | Gross | 51/204 |
| 3,037,333 | 6/1962 | Stelmachowski | 51/346 |
| 3,064,397 | 11/1962 | Czubak | 51/346 |
| 3,403,481 | 10/1968 | McDonald | 51/204 |

*Primary Examiner*—Harold D. Whitehead
*Assistant Examiner*—K. Bradford Adolphson
*Attorney, Agent, or Firm*—William J. Crossetta, Jr.

[57] ABSTRACT

This invention relates to improved abrading elements for honing tools containing a plurality of abrading elements, which may be rotated and/or radially moved in contact with the surface to be honed, the improvement comprising an abrading element embodying an abrasive article, having an abrading face and an opposite, substantially flat, attachment face, in a molded plastic, unitary, support structure, the unitary support structure having a substantially flat support face to which the attachment face of the abrasive article attaches, the support face having voids therein such that from about 70 to 90 percent of the surface area of the attachment face of the abrasive article is in contact with the support face and the support face being resiliently supported by a triangular truss support bridge intimately molded therewith.

22 Claims, 4 Drawing Figures

ABRADING ELEMENTS

BACKGROUND OF THE INVENTION

1. Field of the Invention

This invention relates to improvements in new and replacement abrading elements for honing tools, and particularly to an improved supporting structure for encasing an abrasive article which structure adds materially to the accuracy of the hone surface while significantly increasing the life of the abrasive article.

2. Description of the Prior Art

This invention is particularly concerned with honing or abrading elements useful in honing apparatus where the abrasive article (honing stone) is mounted and supported in a nonabrasive support structure so that as the abrasive article wears, the encasing portion of the supporting structure likewise will wear and the element may be worn to completion. Abrading elements of this general character as used in honing tools generally comprise an elongated bar of bonded abrasive known as "stick", together with a "carrier" support structure by means of which the stick is laterally supported or backed, with the stick and carrier assembly being mounted in a honing arbor. Briefly, the honing tool environment for abrading elements of this sort usually comprises a spindle which is drivingly connected at its end to a machine which is capable of rotational and/or reciprocating motion to the spindle. At its lower end, the spindle is provided with an abrading head or an arbor having a singular or plurality of circumferentially arranged holders for abrading elements, each holder being adapted to receive therein one or more of the abrading elements. These holders, and accordingly the abrading elements therein, are adapted to be moved radially, outwardly or expanded against the surface of the work piece. With the abrading elements thus expanded outwardly against the surface of the work piece and with reciprocating and/or rotational movements being applied to the spindle, rapid removal of stock from the workpiece undergoing honing will result.

The use of abrading elements comprising abrasive articles mounted in a nonabrasive backing member which wear as the abrasive wears is old in the art of honing. Many such abrading elements are described in the prior art, for example: U.S. Pat. No. 2,467,094, together with U.S. Pat. No. 2,823,498 and U.S. Pat. No. 2,991,597 and U.S. Pat. No. 3,037,333 describe abrading elements useful in honing tools as above described. A problem associated with the prior abrading elements is the speed with which the abrading elements wear, the manner or wear of the support structure and the amount of cleaning and lubricating solution which must be applied to the piece being honed so as to evacuate the debris left behind from this wear. Substantial difficulties have also been encountered with the use of honing tools, equipped with prior art abrading elements particularly as a result of the wear of the abrading elements detrimentally effecting the honing tool. The build-up of debris occasioned by rapid wear of the abrading elements may require frequent replacement of the honing tool body because of the increased wear occasioned thereby.

It is, therefore, an object of the present invention to provide an abrading element which is adopted to undergo a reduced rate of wear than the prior art elements. It is also an object of this invention to provide an abrading element, which, because of its reduced rate of wear, significantly reduces the amount of cleaning and lubricating fluid necessary in cleaning the work piece of abraded material. Further, it is an object of the instant invention to provide an abrading element which will decrease the build-up of abraded material debris and accordingly prolong the life of the honing tool. Still further it is an object of this invention to provide an abrading element which can be easily constructed by extrusion molding.

These and other objects of the present invention will become apparent from the following detailed description of the invention.

SUMMARY OF THE INVENTION

In accordance with this invention there is provided improvement to abrading elements useful in a wide variety of honing apparatus, the improvement comprising embodying a bonded abrasive article, having an abrading working face, a plurality of sides adjacent to said face and an opposite attachment face, in a unitary, partial, nonabrasive, molded plastic, support and guide structure, said support and guide structure, engaging said abrasive article at the attachment face and alternately at one side adjacent to the working face thereof and engaging from at least about 70 to not more than about 90% of the surface area of the attachment face of said abrasive article whereby the support face of said support structure engaging said attachment face of the abrasive article is in turn resiliently supported by a triangular truss support bridge intimately molded therewith.

BRIEF DESCRIPTION OF THE DRAWING

In the embodiment of FIGS. 1–4 inclusive there is illustrated a prefered embodiment of an improved abrading element of the instant invention. The abrading element is attachable at the inner or driven end to an abrading head or arbor, by means of holders, in a conventional honing machine spindle (not shown). The abrading head or arbor may extend either vertically, horizontally, or at any angle depending upon the type of honing machine with which it is to be used.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

DESCRIPTION OF THE PREFERRED EMBODIMENTS

Figure 1:
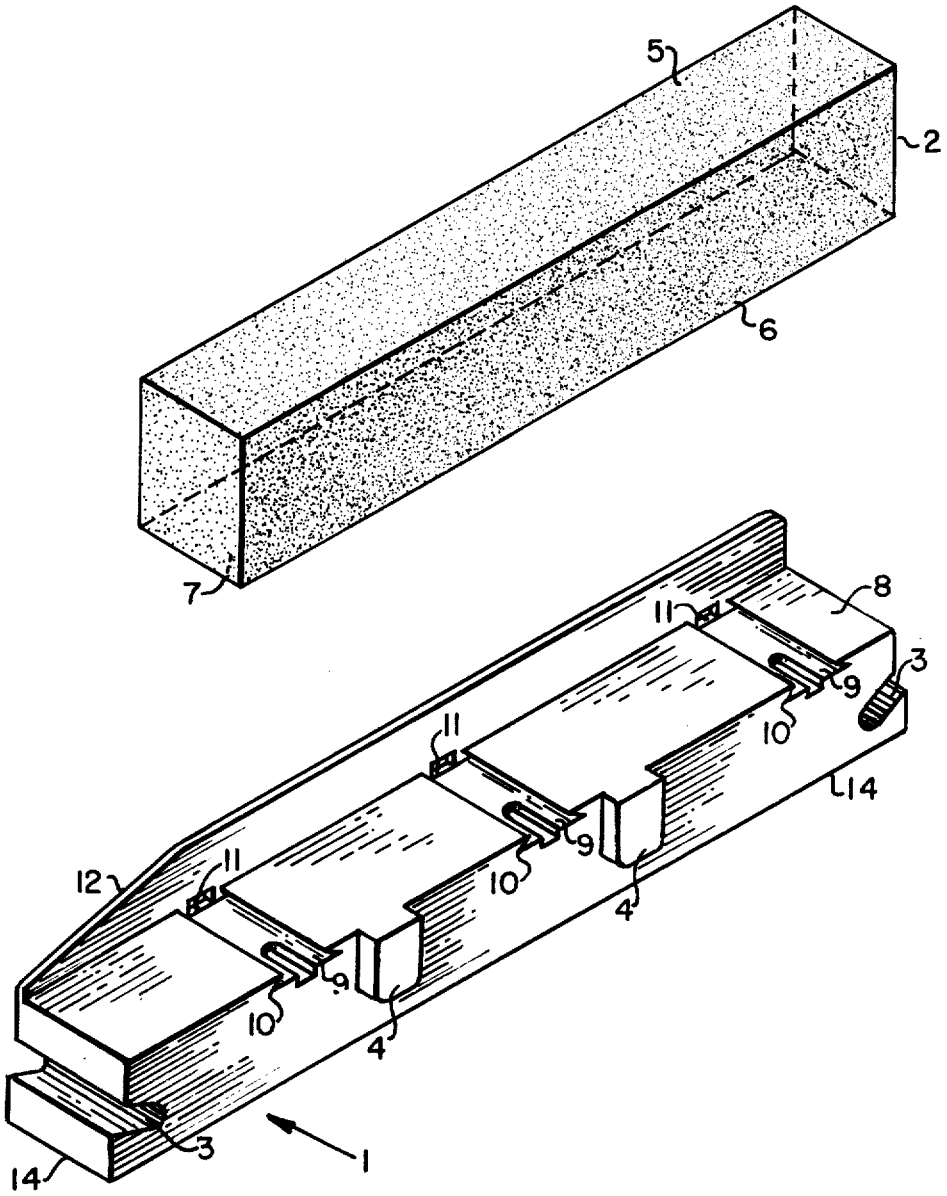

FIG. 1 is an enlarged exploded frontal perspective view of an embodiment of a support and guide structure constructed in accordance with the instant invention.

Figure 2:
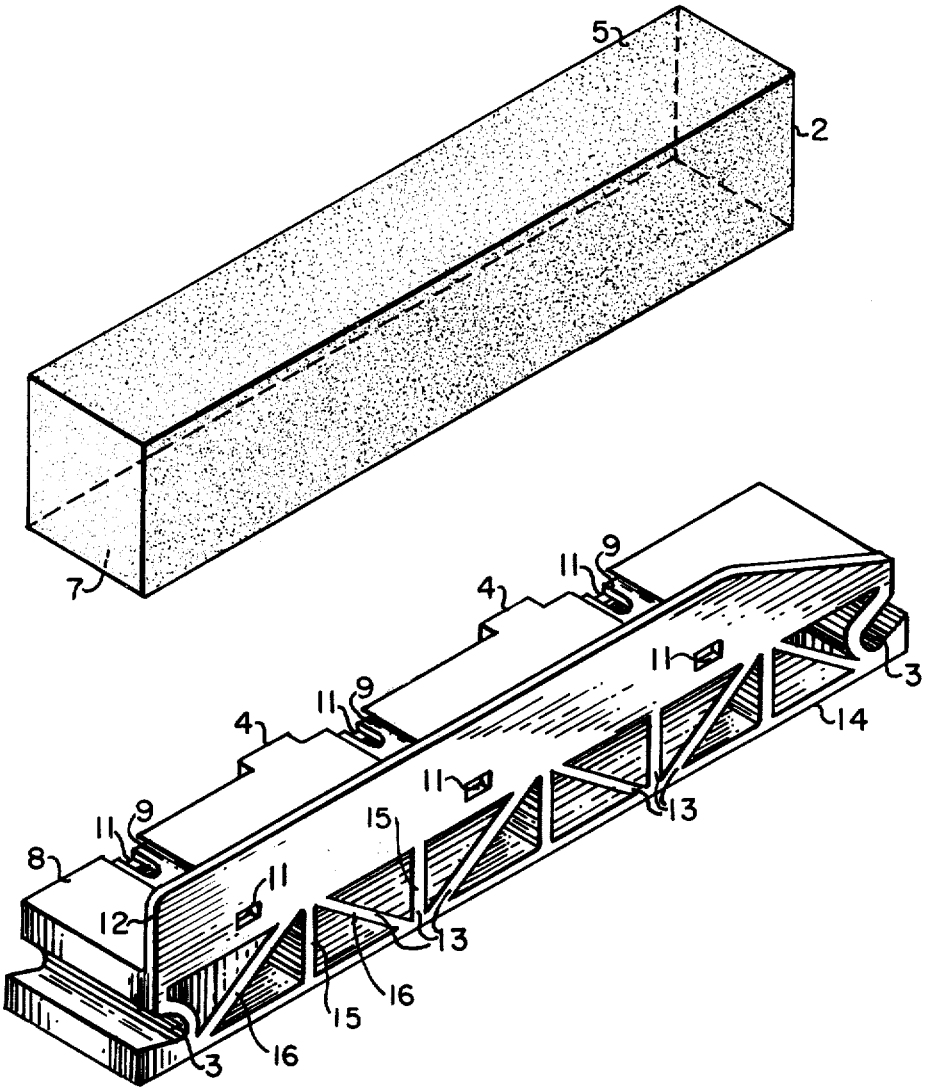

FIG. 2 is an enlarged exploded rear perspective view of an abrading element incorporating the guide and support structure of FIG. 1, and showing operable construction of the triangular truss support bridge relative to the support face of the support and guide structure.

Figure 3:
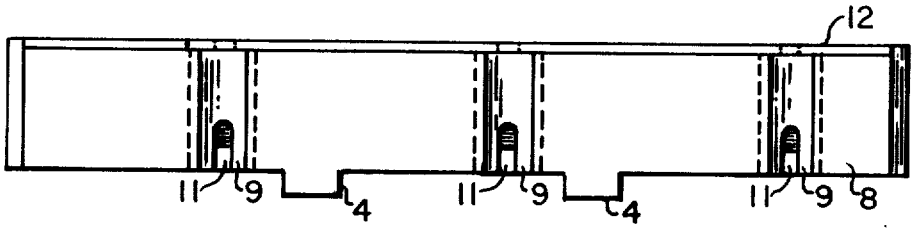

FIG. 3 is a plan view of the abrading element of FIG. 2.

Figure 4:
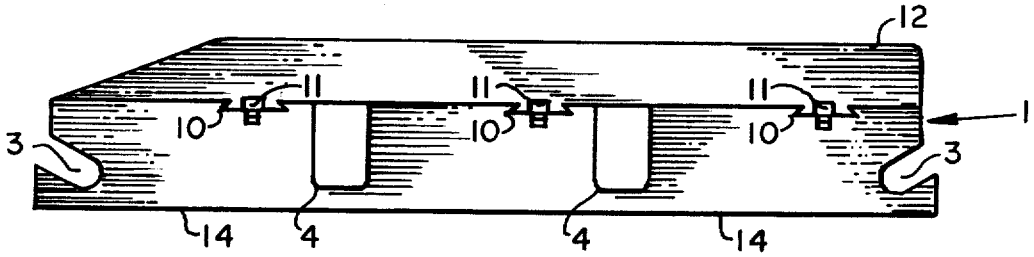

FIG. 4 is a side elevational view of the abrading element of FIG. 2.

The illustrated abrading element comprises a molded plastic support structure 1 made from a wearable, preferably non-abrasive plastic in which an abrasive article 2 is retained by suitable attachment means. Attachment of the abrading element to the abrading head or arbor is by means of attachment slots 3 which accept an attaching means in accord with the design of the abrading head or arbor. Stabilization of the abrading element to the abrading head or arbor is achieved through stabilizing shoulders 4 which conform in size and shape to appropriate recesses in the abrading head or arbor such that undesired movement of the abrading element during working of the apparatus is minimized.

The abrasive article, having working face 5, leading face 6 and attachment face 7, is preferably attached to the support structure 1 at support face 8 by means of an appropriate adhesive. Voids 9 are provided in the support face of the support structure of such size and area that at least about 10 to not more than about 30% of the surface area of the attachment face of said abrasive article will be adjacent such voids; e.g. at least about 70 to not more than about 90% of the surface area of the attachment face of said abrasive article engages the support face of the support structure. In the illustrated supporting structure the voids 9 are shown as slots having beveled sides 10 and glue relief openings 11 therein. Such beveled sides and glue relief openings have been found to add strength to the adhesive bodn for attachment of the abrasive article. It should be understood however that the configuration of the voids in the supporting faces of the support structure is not critical to the generic invention herein providing the percentage of void area to the area of the attachment face of said abrasive article is maintained.

The illustrated abrading element also contains a support lip 12 which provides added support to the abrading article when used in certain abrading heads or arbors. In such instant said support lip also provides an added surface area when adhesively attaching the abrading article. It should be understood that the surface area of the abrading article engaging the support lip is not to be considered when computing the aforedescribed ratio of attachment face surface area to voids. The support lip 12 of the illustrated abrading element may be of any size and dimension as needed to achieve the desired support for the abrading article as is appropriate for the honing operation.

The support of the support face of the support structure is resiliently achieved by intimately molding therein a triangular truss support bridge 13, between the support face 8 and lower face 14. The triangular truss support bridge is comprised of support members 15 and diagonal web member 16 which extend between the support face 8 and lower face 14. The triangular truss support bridge allows the support surface of the support structure to resiliently work as the abrading article moves across the article being honed such that intermittencies in movement caused by irregularities of the surface being honed or inconstancies in the materials of the abrading article, are at least in part absorbed, providing a more constant motion and accordingly reducing the incidence of cracking and breakage of the abrasive article and/or "chattering" of the article against the honing surface.

When such conditions as above described exist it has been found that the abrasive element so formed tends to "work" in the honing operation so that less wear occurs to the abrasive article while accomplishing equal or more abrading of the piece being honed. Such effect provides substantial savings on material replacement.

The type of plastic material chosen for the supporting structure is predicated upon the character of the abrasive article used. for example, hard bonded abrasives may require the supporting structure to be composed of a high wear resistant plastic, while soft bonded abrasives would require a plastic with less wear resistance.

Typical abrasive articles operable with the instant invention, are those which are in common use for abrasives, such as refactory metal borides, carbides, nitrides and oxides. For example, suitable materials include borides of aluminum, niobium, silicon tantalum, titanium, tungsten and zirconium; carbides of boron, niobium, silicon, tantalum, titanium, tungsten and zirconium; nitrides of aluminum, boron, niobium, silicon, tantalum, titanium, tungsten and zirconium; and oxides of aluminum, niobium, silicon, tantalum, titanium, tungsten and zirconium. Other materials which can be utilized include the abrasive stones such as granite, etc. and any other material which is commonly used in abrading elements as herein before described.

The plastic support structure may be made of any suitable plastic which is wearable and preferably non-abrasive in quality. Typical plastics of which the support structure of this invention may be made include the homopolymers and copolymers of ethylenically unsaturated aliphatic, alicyclic and aromatic hydrocarbons such as polyethylene, polypropylene, polybutene, ethylenepropylene copolymers; copolymers of ethylene or propylene or with other olefins, polybutadiene; polymers of butadiene, polyisoprene, both natural and synthetic, polystyrene including high impact polystyrene, and polymers of pentene, hexene, heptene, octene, 2-methylpropene, 4-methyl-hexene-1, bicyclo-(2.2.1)-2-heptene, pentadiene, hexadiene, 2,3-dimethylbutadiene-1,3,4-vinylcyclohexene, cyclopentadiene, methylstyrene, and the like. Other polymers useful in the invention include polyhalogenated hydrocarbon polymers, including fluoro polymers such as polytetrafluoroethylene; polysilicone and polyhalogenated silicones; polyindene, indenecoumarone resins; polymers or acrylate esters and polymers of methacrylate esters, acrylate and methacrylate resins such as ethyl acrylate, n-butyl methacrylate, isobutyl methacrylate, ethyl methacrylate and methyl methacrylate; alkyl resins; cellulose derivatives such as cellulose acetate, cellulose acetate butyrate, cellulose nitrate, ethyl cellulose, hydroxyethyl cellulose, methyl cellulose and sodium carboxymethyl cellulose; epoxy resins, furan resins (furfuryl alcohol or furfuralketone); isocyanate resins from petroleum; isobutylene resins (polyisobutylene); isocyanate resins (polyurethanes); melamine resins such as melamine-formaldehyde and melamine-urea-formaldehyde; oleo resins; phenolic epoxy, phenolic-polyamide, and phenolic-vinyl acetals; polyamidepolymer, such as polyamides, polyamide-epoxy and particularly long chain synthetic polymeric amides containing recurring carbonamide groups as an integral part of the main polymers chain; polyacryl amides; polysulfones; polyester resins such as unsaturated polyesters of dibasic acids and dihydroxy compounds, and polyester elastomers and resorcinol resins such as resorcinol-formaldehyde, resorcinol-furfural, resorcinol-phenol-formaldehyde, resorcinol-polyamide and resorcinol-urea; rubbers such as natural rubber, synthetic polyisoprene, reclaimed rubber, chlorinated rubber, polybutadiene, cyclized rubber, butadiene-acrylonitrile rubber, butadiene-styrene rubber, and butyl rubber, neoprene rubber (polychloroprene); polysulfides (Thiokol); terpene resins, urea resins; vinyl resins such as polymers of vinyl acetal, vinyl acetate or vinyl alcohol-acetate copolymers, vinyl alcohol, vinyl chloride, vinyl butyral, vinyl chloride-acetate copolymer, vinyl pyrrolidone and vinyldene chloride copolymer; polyformaldehyde; polyethers, such as polyphenylene oxide, polymers of diallyl phthalates and phthalates; polycarbonates of phosgene or thiophosgene and dihydroxy compounds such as bisphenols, thermoplastic polymers of bisphenols and epichlorohydrin (tradename Phenoxy polymers); graft copolymers and polymers of unsaturated hydrocarbons and an unsaturated monomer, such as graft copolymers of polybutadiene, styrene and acrylonitrile, commonly called ABS resins: ABS-polyvinyl chloride polymers; acrylic polyvinyl chloride polymers; and any other suitable natural and synthetic polymers.

The polymers of the invention can be used in the unfilled condition, or with fillers such as glass fiber, glass powder, glass beads, asbestos, talc and other mineral fillers, wood, flour and other vegetable fillers, carbon in its various forms, dyes, pigments, waxes and the like.

Especially suitable are polymers which are easily moldable and of particular preference are glass filled injection moldable polymers, particularly the glass filled thermo plastic polyesters such as Valox® and Noryl®, a phenylene oxide based resin, both products General Electric Corporation.

The means of attachment of the abrading article to the support face of the support structure may be any convenient means including mechanical means such as clipping means, bolting means including studs incorporated in the abrading article, riveting means and screw means and chemical treatment means such as heat welding, spin welding, solvent cementing and adhesive or glueing means. It is preferred however to use adhesive or glueing means in any form including tape and mastic. The adhesive utilized may be any appropriate adhesive, insoluble and infusable, natural and proteinaceous, pressure sensitive, solvent evaporable and thermal fusable. Typical adhesives include the cellulosic nitrates, cyano acrylates, epoxies, phenolic epoxies, polysulfide epoxies, polyamide epoxies, furanes, GRS-rubber-based and neoprene-based solvent and aqueous type, nitrile phenolics, nitrile rubber based, phenol formaldehydes, polybutadiene, polymethane, resorcinol, formaldehyde, silicone resin based, unsaturated polyester-styrene, urea formaldehyde or vinyl phenolics. It should be understood that the support face and/or the support lip, as well as the attachment face of the abrading article, of the support structure may be treated prior to or while applying the adhesive to provide a more suitable surface for adherancy. Such treatment may include roughing, etching, including chemical, mechanical and thermal, or other methods commonly known in the art.

I claim:

1. An abrading element comprising a preformed abrasive article having an abrading face and an opposite attachment face, in a molded plastic unitary support structure, said unitary support structure having a flat support face to which the attachment face of the abrasive article attaches and said support face having voids therein such that from about 70 to about 90 percent of the surface area of the attachment face of said abrasive article is in contact with said support face and from about 10 to about 30 percent of said surface area is opposite said voids, and said support face being resiliently supported by a triangular truss support bridge intimately molded therewith.

2. The abrading element of claim 1 wherein said voids are slotted depressions having beveled sides therein.

3. The abrading element of claim 2 comprising three of said slots.

4. The abrading element of claim 2 wherein said support structure contains glue relief openings adjacent to said slots.

5. The abrading element of claim 2 wherein said support structure has a perpendicular support lip adjacent to the support face.

6. The abrading element of claim 2 wherein said abrading article is substantially rectangular.

7. The abrading element of claim 6 wherein the attachment face of said abrading article and the support face of said support structure is substantially flat.

8. The abrading element of claim 2 wherein said support structure is injection formed and said plastic is a glass filled polyester.

9. The abrading element of claim 8 wherein said plastic is a glass filled phenylene oxide.

10. The abrading element of claim 2 wherein said abrading article is adhesively attached to said support structure.

11. The abrading element of claim 10 wherein at least the support face of said support structure is etched prior to adhesively attaching said abrading article.

12. An abrading element comprising a substantially rectangular abrading article having an abrading face and an opposite attachment face adhesively attached to the support face of an injection molded plastic unitary support structure, said support face being substantially flat having three beveled slotted depressions therein such that from about 10 to about 30 percent of the surface area of the attachment face of said abrasive article is opposite said slots and said support face having an intimately molded perpendicular support lip extending from the trailing edge of said support face, sad support lip being adhesively attached to the trailing side of said abrasive article and said support face being resiliently supported by a triangular truss support bridge intimately molded therewith.

13. The abrading element of claim 12 wherein said plastic is a glass filled polyester polymer.

14. The abrading element of claim 12 wherein said plastic is a glass filled phenylene oxide polymer.

15. The abrading element of claim 12 wherein said perpendicular support lip contains glue relief openings adjacent said beveled slots.

16. The abrading element of claim 12 wherein said slots contain glue relief openings therein.

17. An abrading element support structure for use in combination with an abrasive article comprising a molded unitary plastic body having a support face adapted for attachment of the abrasive article and an opposite lower face having intimately molded therebetween, a triangular truss support bridge which provides resilient support for said support face, said support face having intimately molded thereto at the trailing edge, a perpendicular support lip.

18. The structure of claim 17 wherein said support face contains voids therein.

19. The structure of claim 18 wherein said voids are beveled slotted depressions.

20. The structure of claim 17 wherein said plastic is selected from a glass filled polyester and glass filled phenylene oxide.

21. The abrading element of claim 1, wherein said voids distributed on the support face of the support structure symmetric in approximate equal size on each side of the intersect of the symmetric axis of the attachment face of the abrading article.

22. The abrading element of claim 12, wherein said slotted depressions are distributed on the support face of the support structure in approximate equal size on each side of the intersect of the symmetric axis of the attachment face of the abrading article.

* * * * *